US006650043B1

(12) United States Patent
Derraa

(10) Patent No.: US 6,650,043 B1
(45) Date of Patent: Nov. 18, 2003

(54) MULTILAYER CONDUCTOR STRUCTURE FOR USE IN FIELD EMISSION DISPLAY

(75) Inventor: Ammar Derraa, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/358,165

(22) Filed: Jul. 20, 1999

(51) Int. Cl.[7] ..... H01J 1/02; H01J 1/304

(52) U.S. Cl. ..... 313/497; 313/495; 313/309; 313/351

(58) Field of Search ..... 313/495, 496, 313/497, 309, 310, 311, 336, 351; 315/169.1, 169.3; 257/751, 750, 748, 766

(56) References Cited

U.S. PATENT DOCUMENTS

| | | | | |
|---|---|---|---|---|
| 4,517,226 A | | 5/1985 | Baldi et al. | 437/245 |
| 4,525,733 A | | 6/1985 | Losee | 257/773 |
| 4,556,897 A | | 12/1985 | Yorikane et al. | 257/763 |
| 4,561,009 A | | 12/1985 | Yonezawa et al. | 257/765 |
| 4,786,962 A | | 11/1988 | Koch | 257/751 |
| 4,899,206 A | | 2/1990 | Sakurai et al. | 257/734 |
| 4,942,138 A | | 7/1990 | Miki | 437/182 |
| 5,106,781 A | | 4/1992 | Penning De Vries | 437/192 |
| 5,313,100 A | | 5/1994 | Ishii et al. | 257/751 |
| 5,393,565 A | | 2/1995 | Suzuki et al. | 427/255.2 |
| 5,399,236 A | | 3/1995 | Ha Jae et al. | 156/643 |
| 5,406,121 A | | 4/1995 | Toyoda | 257/740 |
| 5,449,640 A | | 9/1995 | Hunt et al. | 438/640 |
| 5,470,792 A | | 11/1995 | Yamada | 437/195 |
| 5,534,743 A | * | 7/1996 | Jones et al. | 313/309 |
| 5,587,339 A | | 12/1996 | Wyborn et al. | 437/195 |
| 5,594,297 A | * | 1/1997 | Shen et al. | 313/309 |
| 5,641,703 A | | 6/1997 | Cohen et al. | 438/467 |
| 5,663,608 A | * | 9/1997 | Jones et al. | 313/309 |
| 5,751,272 A | | 5/1998 | Silverbrook et al. | 345/149 |
| 5,786,232 A | | 7/1998 | Stansbury | 438/20 |
| 6,010,918 A | * | 1/2000 | Marino et al. | 438/20 |
| 6,168,873 B1 | * | 1/2001 | Ikeda et al. | 257/741 |
| 6,211,608 B1 | * | 4/2001 | Raina et al. | 313/309 |
| 6,317,185 B1 | * | 11/2001 | Harano et al. | 349/147 |
| 6,348,403 B1 | * | 2/2002 | Raina et al. | 438/618 |
| 6,425,791 B1 | * | 7/2002 | Raina et al. | 445/24 |
| 6,461,211 B1 | * | 10/2002 | Raina et al. | 445/24 |

FOREIGN PATENT DOCUMENTS

| | | | | |
|---|---|---|---|---|
| EP | 0112417 | | 7/1984 | |
| JP | 62-8125 | | 1/1987 | |
| JP | 403127437 A | * | 5/1991 | H01J/31/15 |
| JP | 051142576 A | * | 6/1993 | H01L/29/40 |

* cited by examiner

*Primary Examiner*—Vip Patel
*Assistant Examiner*—Karabi Guharay
(74) *Attorney, Agent, or Firm*—Hale and Dorr LLP

(57) ABSTRACT

The disclosed multilayer conductor may be used in place of aluminum conductive lines in integrated circuits and field emission displays. The multilayer conductor includes a primary conductive line, preferably made from aluminum, and a protective line, preferably made from chromium. The protective line separates the aluminum from adjacent silicon-based layers.

31 Claims, 5 Drawing Sheets

MULTILAYER CONDUCTOR STRUCTURE FOR USE IN FIELD EMISSION DISPLAY

MULTILAYER CONDUCTOR

The present invention was made with Government support under Contract No. DABT63-97-C-0001 awarded by the Department of Defense. The Government has certain rights in the invention.

FIELD OF THE INVENTION

The present invention relates to an improved multilayer conductor for use with electrical circuits. Multilayer conductors constructed according to the invention may be used advantageously in field emission displays (FEDs) as well as in other integrated circuits.

BACKGROUND OF THE INVENTION

Since a preferred use of the invention is in FEDs, the background of FEDs will now be discussed. FIG. 1A shows a cross sectional view of a portion of a prior art FED 100. FED 100 includes a cathode, or baseplate, 102 and an anode, or faceplate, 104. Baseplate 102 includes a substrate 106, a plurality of conical field emitters 108, a dielectric layer 110, and a conductive grid layer 112. Dielectric layer 110 is disposed over substrate 106, and grid layer 112 is disposed over dielectric layer 110. Dielectric layer 110 defines a plurality of cylindrical, or bowl shaped, void regions 114, and each emitter 108 is disposed over substrate 106 in one of the void regions 114. Grid layer 112 defines a plurality of circular apertures 116. Each aperture 116 corresponds to, and overlies, one of the void regions 114. A single emitter 108 is disposed underneath each of the apertures 116. The apertures 116 are positioned so that (1) the grid layer 112 does not obstruct a path 117 between the upper tips of the emitters 108 and the faceplate 104 and (2) a portion of the grid layer 112 is proximal to the upper tip of each emitter 108. Baseplate 102 also includes a plurality of conductive column lines 118 disposed between emitters 108 and substrate 106. In FIG. 1A, portions of three column lines are shown as lines 118*a*, 118*b*, and 118*c*.

FIG. 1B shows a magnified top view of a portion of baseplate 102. The grid layer 112 is arranged as a set of conductive row lines (three of which 112*a*, 112*b*, 112*c* are shown) with the row lines being perpendicular to the underlying column lines 118.

Referring again to FIG. 1A, faceplate 104 includes a transparent glass plate 120, a transparent conductor 122, and a phosphor layer 124. Transparent conductor 122 is disposed on one major surface of glass plate 120, and phosphor layer 124 is disposed on transparent conductor 122. Faceplate 104 also includes a black matrix (not shown). The black matrix divides the phosphor layer into an array, or matrix, of pixels. The location of one of the pixels 160 is indicated in FIG. 1A. Pixel 160 could be a single pixel of a black and white display or alternatively could form a single red, green, or blue dot of a color (RGB) display. The faceplate 104 and baseplate 102 are spaced apart from one another and are disposed so that the phosphor layer 124 is proximal to the grid layer 112.

The collection of emitters 108 disposed at the intersection of a single row line and a single column line are used to control illumination of a single pixel of the display 100. For example, as shown in FIG. 1B, a group 162 of approximately sixteen emitters 108 (disposed within the approximately sixteen apertures 116) is located at the intersection of row line 112*b* (of the grid layer 112) and column line 118*b*.

This group 162 of emitters is used to control illumination of pixel 160 (indicated in FIG. 1A). Typical displays often use hundreds or thousands of emitters to control illumination of a single pixel. However, for convenience of illustration, FIG. 1B shows only about sixteen emitters per pixel.

Referring again to FIG. 1A, FED 100 also includes a plurality of spacers 130 disposed between faceplate 104 and baseplate 102. The spacers 130 maintain the orientation between baseplate 102 and faceplate 104 so that the baseplate and faceplate are substantially parallel to one another. Outer walls (not shown) seal the outer periphery of FED 100 and the space between baseplate 102 and faceplate 104 is substantially evacuated (creating a vacuum of about $10^{-7}$ Torr). Since the space between faceplate 104 and baseplate 102 is substantially evacuated, atmospheric pressure tends to press baseplate 102 and faceplate 104 together. Spacers 130 resist this pressure and maintain the substantially parallel, spaced apart, orientation of baseplate 102 and faceplate 104.

FED 100 also includes a power supply 140 for (1) charging the transparent conductor 122 to a highly positive voltage (e.g., 1,500 Volts); (2) selectively charging rows of the conductive grid layer 112 to a positive voltage (e.g., 30 Volts); and (3) selectively charging the conductive column lines 118 to a negative voltage (e.g., −10 Volts).

In operation, voltages applied to the column lines 118, the rows of the grid layer 112, and the transparent conductor 122 selectively cause emitters 108 to emit electrons 150 that travel along path 117 towards, and impact on, phosphor layer 124. Incident electrons on phosphor layer 124 cause phosphor layer 124 to emit photons and thereby generate a visible display on faceplate 104. Power supply 140 generates a visible display by periodically illuminating (or not illuminating) the pixels in the display matrix. Normally, power supply 140 continuously charges transparent conductor 122 to the highly positive voltage. Power supply 140 illuminates a single pixel by simultaneously applying the negative and positive voltages to that pixel's column and row lines, respectively.

The column lines 118 and the rows of the grid layer 112 are typically made from strips of aluminum. Although aluminum has been used for many years to form conductors in FEDs as well as in other types of integrated circuits, aluminum has several undesirable characteristics. For example, aluminum is not physically stable over long periods of time when it is disposed adjacent to silicon-based materials. Aluminum has a tendency to slowly diffuse into adjacent silicon-based materials and form structures known as "hillocks". Since almost every layer of modern integrated circuits is silicon-based (e.g., silicon oxide, silicon nitride, single crystal silicon, polycrystalline silicon, or glass), the tendency of aluminum to diffuse into silicon-based layers is a serious drawback to its use. As used herein, the term "silicon-based" shall mean any material that includes silicon, either in elemental form or in the form of one or more compounds.

FIGS. 2A, 2B, 2C, 2D illustrate the undesirable tendency of aluminum for forming hillocks in adjacent silicon-based layers. FIG. 2A shows a top view of a structure 200 and FIG. 2B shows a magnified sectional view of structure 200 taken in a direction indicated by line 2B—2B as shown in FIG. 2A. Structure 200 includes four conductive aluminum lines 210, 211, 212, 213 disposed between, and in physical contact with, a lower silicon-based layer 202 and an upper silicon-based layer 204. It will be appreciated that structure 200 could represent a small portion of almost any integrated circuit.

The lower silicon-based layer 202 could comprise a substrate made for example from single crystal silicon, polycrystalline silicon, or glass. More commonly, both upper and lower silicon-based layers 202, 204 would be silicon-based insulators made for example from silicon oxide or silicon nitride. In this case, additional layers (e.g., silicon-based layers containing active devices such as transistors) could be disposed both above and below the upper and lower silicon-based layers 202, 204. It will be further appreciated that aluminum lines 210–213 could comprise a small portion of a bus (e.g., an address bus or a data bus) in a memory or processor chip. Alternatively, aluminum lines 210–213 could comprise a portion of the column lines in a FED. In that case, lower silicon-based layer 202 would be part of the baseplate 102 (as shown in FIG. 1A). In typical applications the width W of the conductive lines is about 2,000 Angstroms and the thickness T of the conductive lines is about 1,000 to 2,000 Angstroms. Although the illustrated aluminum lines are "straight lines", it should be appreciated that conductive "lines" in integrated circuits are typically not straight and instead include several line segments or arcs connected by right angles or other angles. The term "line" as used herein refers to a conductor that extends along any path between two points.

FIGS. 2C and 2D show top and magnified sectional side views, respectively, of structure 200 after some of the aluminum from line 211 has diffused into the lower silicon-based layer 202 and formed a hillock 211A. The hillock 211A is a "thread" or "spike"of aluminum that has diffused from its original location (over lower silicon-based layer 202) into silicon-based layer 202. Typically, formation of the hillock 211A will increase the electrical resistance of the line 211 and thereby degrade the performance of structure 200. Also, if enough aluminum from the line diffuses into the hillock, formation of the hillock can cause a "break" or an "open circuit" to form in the aluminum line. Sometimes hillocks extend towards adjacent conductive lines and can result in electrically connecting two previously unconnected lines.

Typically, aluminum diffuses rather slowly into adjacent silicon-based layers and it normally takes several years to form hillocks of appreciable size. However, this diffusion process is not well understood and hillocks sometimes form much faster.

Another problem with aluminum is that it suffers from a phenomenon known as "electromigration". In some materials, conduction of electric current can cause permanent physical movement of the material, and this movement is called "electromigration". Typically, the amount of electromigration experienced by a material is somewhat proportional to the amount of electric current conducted by the material. So electromigration is a more serious problem for high current devices such as FEDs than it is for low current devices such as logic gates. Aluminum typically experiences some degree of electromigration regardless of where the aluminum is disposed. However, when aluminum is disposed in physical contact with a silicon-based material (e.g., as in a typical integrated circuit application), the tendency of aluminum to experience electromigration exacerbates the above-discussed tendency for aluminum to form hillocks.

Yet another problem with aluminum relates aluminum's susceptibility to corrosion by etchants typically used in fabrication of integrated circuit devices. For example, aluminum is susceptible to corrosion by hydrogen-fluoride-based etchants (e.g., such as the etchants used in "buffered oxide etches") and by sulfuric-acid-based etchants such as Piranha™, both of which are used to etch the dielectric layer in FEDs. Since aluminum is susceptible to corrosion by these etchants, it can be difficult to form other features in electronic devices (e.g., the dielectric layer in an FED) without simultaneously damaging aluminum lines.

One known technique for addressing these problems with aluminum is to dope the aluminum lines with various dopants (e.g., 4 wt % Copper and 1.7 wt % Silicon). One problem with this technique is that doping an aluminum line tends to raise the per-unit-length electrical resistance of the line.

It would therefore be advantageous to develop other solutions to the problems with aluminum.

SUMMARY OF THE INVENTION

The invention is directed to an improved multilayer conductor. Multilayer conductors constructed according to the invention provide absolution to the above-discussed problems associated with using aluminum lines as conductors in integrated circuits. In a typical embodiment, a multilayer conductor constructed according to the invention includes a line of aluminum (or another highly conductive material) disposed between two lines of chromium (or between two lines of another physically stable conductive material). When the multilayer conductor is used in an integrated circuit, the two lines of chromium shield the aluminum line from physical contact with adjacent silicon-based layers.

Chromium tends to be physically stable when disposed in physical contact with silicon-based materials. More specifically, chromium does not tend to diffuse into adjacent silicon-based materials and form hillocks and chromium does not suffer appreciably from electromigration. Also, chromium and aluminum are physically stable when they are disposed in physical contact with one another. In essence, the chromium forms a protective shield around the aluminum that preserves the original geometric configuration of the aluminum line over very long periods of time.

Another advantage of chromium is that it is more resistant than aluminum to corrosion by etchants (e.g., hydrogen-fluoride-based etchants or sulfuric-acid based etchants) commonly used in fabrication of integrated circuits. So, chromium tends to protect the integrity of multilayer conductors constructed according to the invention during integrated circuit fabrication processes.

The electrical resistance of chromium is higher than that of aluminum. However, chromium is an electrical conductor, so if an unintended break does develop in an aluminum line of a multilayer conductor constructed according to the invention (e.g., as a result of a flaw in the fabrication process), the chromium lines can provide a conductive bridge around the break. The multilayer conductor of the invention therefore provides improved reliability and an increased tolerance for fabrication flaws. Also, even though the electrical resistance of chromium is higher than that of aluminum, the electrical resistance provided between any two points of a multilayer conductor constructed according to the invention can be controlled by appropriately selecting the dimensions of the aluminum and chromium lines. In general, the electrical resistance of a multilayer conductor constructed according to the invention can be reduced by increasing the dimensions, or cross-sectional area, of the aluminum and chromium lines used to form the conductor.

Multilayer conductors constructed according to the invention can be advantageously substituted for aluminum conductors in almost any integrated circuit. For example, multilayer conductors can be used as conductors in memory chips, processor chips, amplifiers, linear circuits, logic circuits, or FEDs.

As discussed above, the preferred embodiment of the multilayer conductor includes an aluminum line disposed between two chromium lines. More generally, multilayer conductors constructed according to the invention include a primary conductive layer disposed between two protective layers. Although the most common material for use as the primary conductive layer is aluminum, other materials such as aluminum containing alloys, copper, copper containing alloys, or other alloys could be used. Also, while chromium is the most preferred choice for the protective layer, other materials such as chromium containing alloys or tungsten could be used.

Whereas prior art integrated circuits have used conductive lines fabricated from a single layer of metal (e.g., a layer of aluminum or copper), the invention provides a conductor that is fabricated from at least two distinct layers of different materials (e.g., one layer of aluminum and another layer of chromium). As discussed herein, forming conductors from two distinct layers of different materials provides significant advantages.

The preferred embodiment of the invention is a multilayer conductor that includes one primary conductive line disposed between two adjacent protective lines. However, other embodiments could include only a single protective line (e.g., for applications in which only one side of the multilayer conductor is in physical contact with a silicon-based material). Still other embodiments could include more than three layers. For example, a multilayer conductor constructed according to the invention could include two primary conductive lines and three protective lines. One of the protective lines separates the two primary conductive lines and the other two protective lines are disposed on the top and bottom of the multilayer conductor.

Still other objects and advantages of the present invention will become readily apparent from the following detailed description wherein several embodiments are shown and described, simply by way of illustration of the best mode of the invention. As will be realized, the invention is capable of other and different embodiments, and its several details are capable of modifications in various respects, all without departing from the invention. Accordingly, the drawings and description are to be regarded as illustrative in nature, and not in a restrictive or limiting sense, with the scope of the application being indicated in the claims.

BRIEF DESCRIPTION OF THE FIGURES

For a fuller understanding of the nature and objects of the present invention, reference should be made to the following detailed description taken in connection with the accompanying drawings in which the same reference numerals are used to indicate the same or similar parts wherein.

DETAILED DESCRIPTION OF THE PREFERRED EMBODIMENTS

Figure 3B:
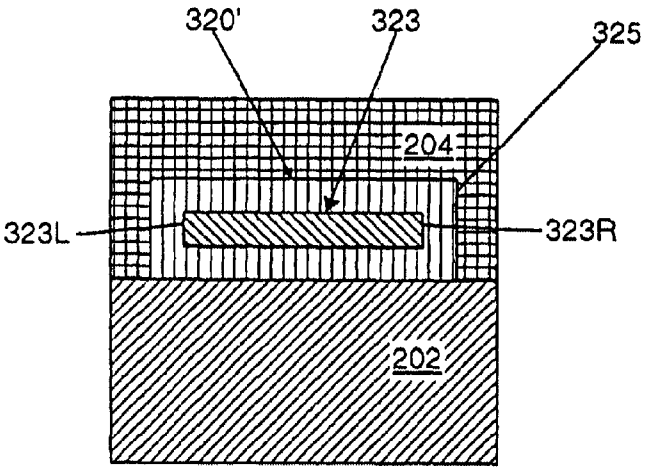
FIG. 3B shows a sectional side view of another multilayer conductor constructed according to the invention and disposed between two layers of silicon-based materials.
Figure 3A:
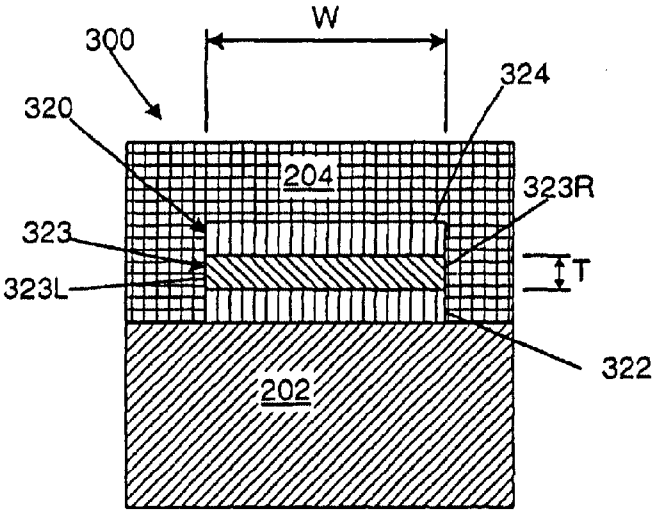
FIG. 3A shows a sectional side view of a multilayer conductor constructed according to the invention and disposed between two layers of silicon-based materials.

FIG. 3A shows a sectional view of an improved multilayer conductor 320 constructed according to the invention. More specifically, FIG. 3A shows a sectional view of a structure 300 that includes a multilayer conductor 320 disposed between lower silicon-based layer 202 and upper silicon-based layer 204. Multilayer conductor 320 includes a primary conductive line 323 that is sandwiched between a lower protective line 322 and an upper protective line 324. Primary conductive line 323 is preferably fabricated from aluminum. The upper and lower protective lines 322, 324 are preferably fabricated from chromium.

As shown in FIG. 3A, the lower protective line 322 forms a barrier between the primary conductive line 323 and the lower silicon-based layer 202. Similarly, the upper protective line 324 forms a barrier between the primary conductive line 323 and the upper silicon-based layer 204. As stated above, in prior art structures, aluminum conductive lines were disposed in physical contact with layers of silicon-based materials such as lower and upper layers 202, 204. Further, that physical contact (1) permitted the aluminum to diffuse into adjacent silicon-based layers and form hillocks and (2) facilitated electromigration. In contrast to the prior art, in preferred embodiments of the invention, chromium protective lines physically separate aluminum conductive lines from adjacent silicon-based layers.

Chromium is a preferred choice for fabricating the upper and lower protective lines 322, 324 because (1) chromium is physically stable when disposed in physical contact with silicon-based layers and does not tend to diffuse into.adjacent silicon-based layers; (2) chromium does not suffer appreciably from electromigration; and (3) chromium and aluminum are physically stable when disposed in physical contact with one another and do not tend to diffuse into each other. The chromium protective lines form a protective shield around the aluminum primary conductive line and tend to prevent the aluminum primary conductive line from moving, flowing, diffusing, or breaking.

As shown in FIG. 3A, the protective lines prevent the upper and lower surfaces of the aluminum primary conductive line 323 from contacting the adjacent silicon-based layers. However, the left and right edges 323L, 323R of line 323 do contact silicon-based layer 204. In typical embodiments, the width W of conductive line 323 is about 2,000 Angstroms and the thickness T of conductive line 323 is about 1,000 to 2,000 Angstroms. Since the thickness T is generally smaller than the width W, it is acceptable to allow the left and right edges 323L, 323R to contact a silicon-based layer. Generally, this small amount of contact between the aluminum line and the adjacent silicon-based layer will not facilitate any significant amount of diffusion or electromigration. However, in other embodiments of the invention, the contact between the left and right edges 323L, 323R of the primary conductive line 323 and a silicon-based layer can be eliminated.

FIG. 3B shows a sectional view of another embodiment of a multilayer conductor 320' constructed according to the invention. Multilayer conductor 320' includes a central primary conductive line 323 and a protective sheath 325 that is wrapped around the primary conductive line 323. As with the lower and upper protective lines 322, 324 of multilayer conductor 320, protective sheath 325 separates the upper and lower surfaces of primary conductive line 323 from the silicon-based layers 202, 204. However, protective sheath 325 also separates the left and right edges 323L, 323R of the primary conductive line 323 from the adjacent silicon-based layers. Conductor 320' is generally more expensive to fabricate than conductor 320. It is therefore contemplated that multilayer conductor 320 will be primarily used. However, it should be appreciated that any references herein to multilayer conductor 320 could also apply to conductor 320'.

Figure 4B:
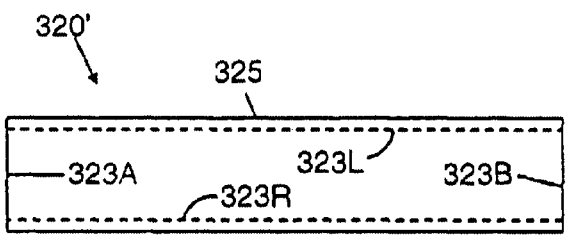
FIGS. 4B and 4C show top and side views taken in the directions indicated by the lines 4B—4B and 4C—4C, respectively, of the conductor shown in FIG. 4A.
Figure 4C:
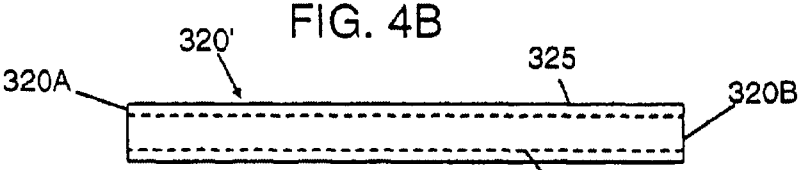
Figure 4A:
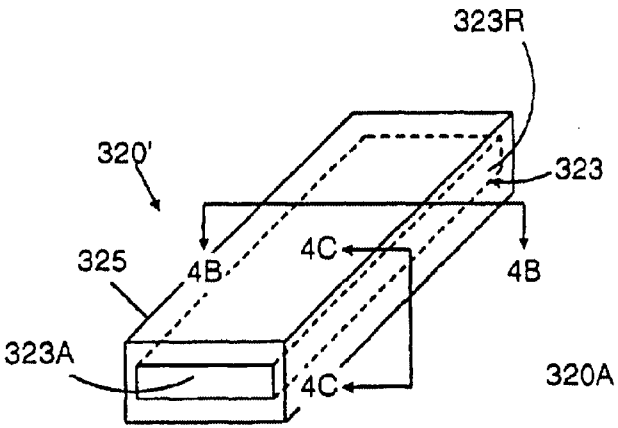
FIG. 4A shows a perspective view of a multilayer conductor constructed according to the intention.

FIG. 4A shows a perspective view of conductor 320'. For convenience of illustration, the silicon-based layers in contact with conductor 320' are not shown. FIGS. 4B and 4C show top and side views, respectively, of the conductor 320' shown in FIG. 4A. As shown in FIG. 4B (and as also shown in FIG. 3B), the protective sheath 325 covers the left and right edges 323L, 323R of the primary conductive line 323. However, at the ends 320A, 320B of the conductor 320', the protective sheath 325 does not cover the ends 323A, 323B of the primary conductive line 323. It is normally desirable to leave the ends 323A, 323B of the primary conductive line 323 exposed in this fashion because it reduces the electrical resistance provided by the conductor 320'.

Generally, the purpose of fabricating a multilayer conductor, or any conductor, is to provide an electrical connection between two devices (e.g., a via, a transistor, or capacitor). Since the chromium protective sheath 325 does not cover the ends 323A, 323B, such devices can connect directly to the aluminum line 323. If the devices could not connect directly to the aluminum primary conductive line 323 and could instead only contact the protective sheath, the electrical resistance of the path between the two devices would be increased. However, it should be appreciated that it is possible to use the protective sheath 325 to cap, or cover, the ends 323A, 323B of the primary conductive line if it is appropriate for a particular application. Also, in other embodiments, the protective lines 322, 324 (e.g., as illustrated in FIG. 3A) could also be used to cap, or cover, the ends of the primary conductive line.

Figure 2B:
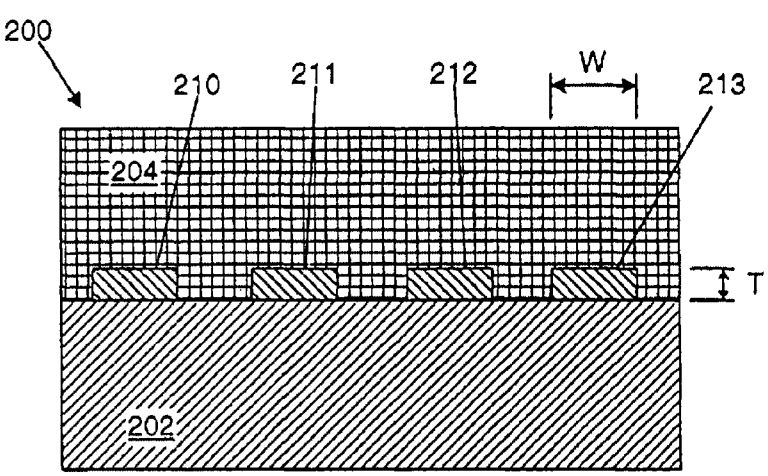
FIG. 2B PRIOR ART
FIG. 2B shows a magnified sectional side view taken in the direction indicated by the line 2B—2B of the structure shown in FIG. 2A.
Figure 2A:
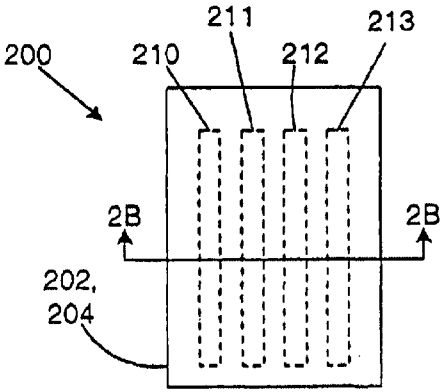
FIG. 2A PRIOR ART
FIG. 2A shows a top view of a prior art structure that includes four aluminum conductive lines disposed between layers of silicon-based materials.
Figure 2D:
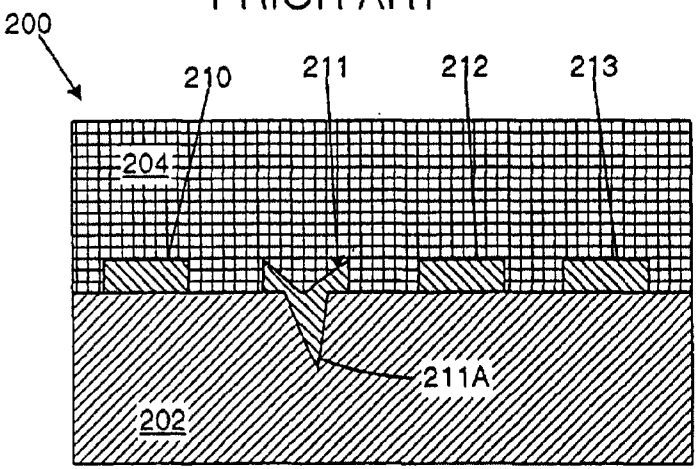
FIG. 2D PRIOR ART
FIG. 2D shows a magnified sectional side view taken in the direction indicated by the line 2D—2D of the structure shown in FIG. 2C.
Figure 2C:
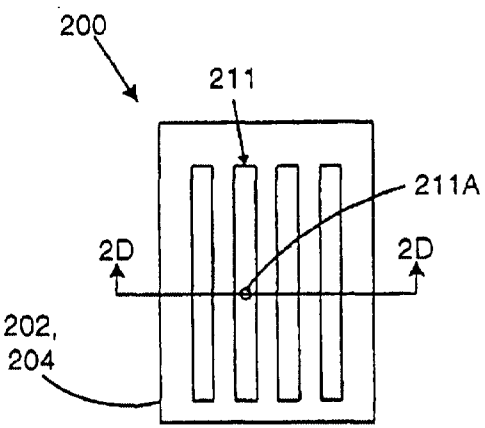
FIG. 2C PRIOR ART
FIG. 2C shows a top view of the structure shown in FIG. 2A after some of the aluminum in one of the lines has diffused into one of the silicon-based layers and formed a hillock.
Figure 5B:
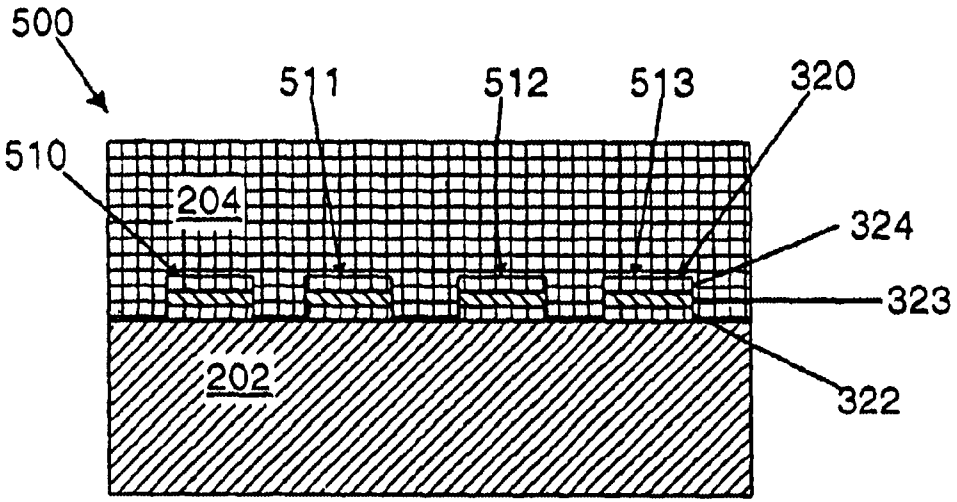
FIG. 5B shows a magnified sectional side view taken in the direction indicated by line 5B—5B of the structure shown in FIG. 5A.
Figure 5A:
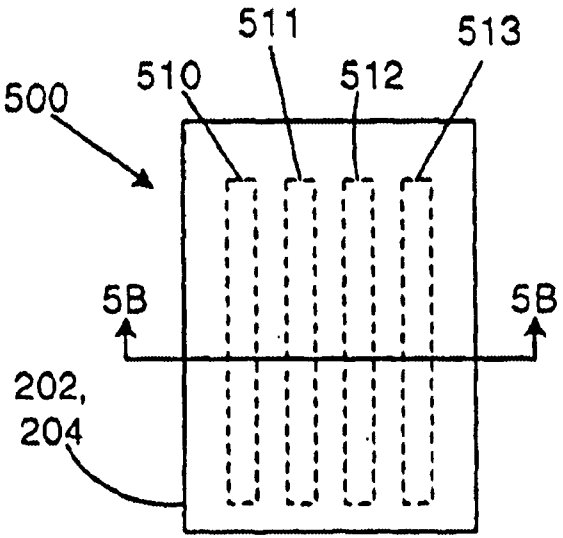
FIG. 5A shows a top view of a structure constructed according to the invention including four multilayer conductors disposed between two adjacent layers of silicon-based materials.

FIGS. 5A and 5B illustrate one way to use the multilayer conductor 320 according to the invention. FIG. 5A shows a top view of a structure 500 and FIG. 5B shows a magnified sectional view of structure 500 taken in the direction indicated by line 5B—5B as shown in FIG. 5A. Structure 500 includes four conductive lines 510, 511, 512, 513 disposed between lower silicon-based layer 202 and upper silicon-based layer 204. As shown most clearly in FIG. 5B, each of the conductive lines 510–513 is fabricated as a multilayer conductor 320 and includes a primary conductive line 323 disposed between lower and upper protective lines 322, 324. It will be appreciated that structure 500 is similar to structure 200 (as shown in FIGS. 2A and 2B). However, rather than simply using aluminum lines 210–213 as conductors, structure 500 uses a multilayer conductor 320 to form the conductive lines 510–513 according to the invention. Structure 500 could be a small portion of almost any integrated circuit (e.g., a processor or memory chip). In general, a multilayer conductor 320 (or 320') constructed according to the invention can be substituted for an aluminum line in any prior art integrated circuit.

Figure 1A:
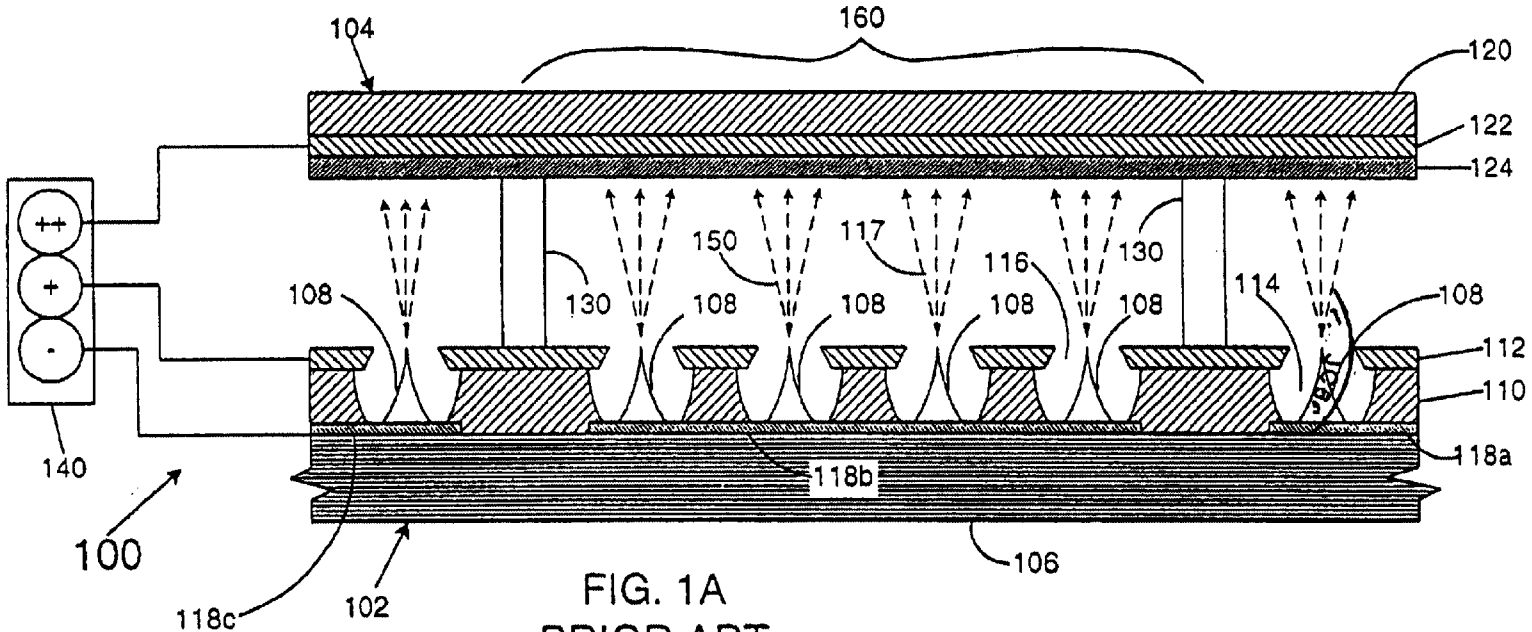
FIG. 1A PRIOR ART
FIG. 1A shows a sectional side view of a portion of a prior art FED.
Figure 1B:
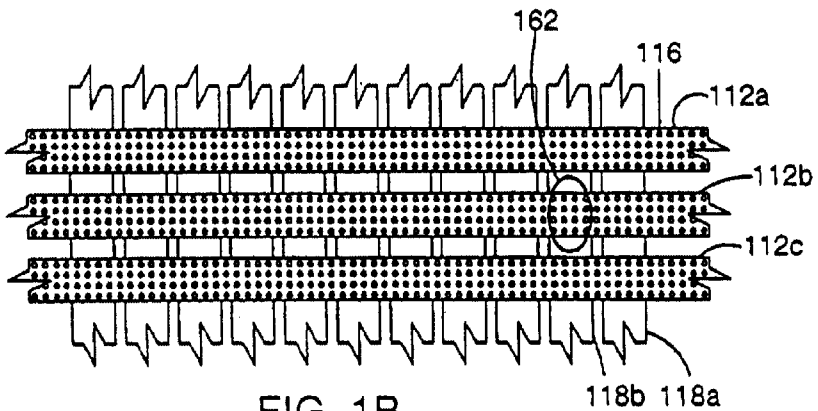
FIG. 1B PRIOR ART
FIG. 1B shows a top view of a portion of the baseplate shown in FIG. 1A.
Figure 6A:
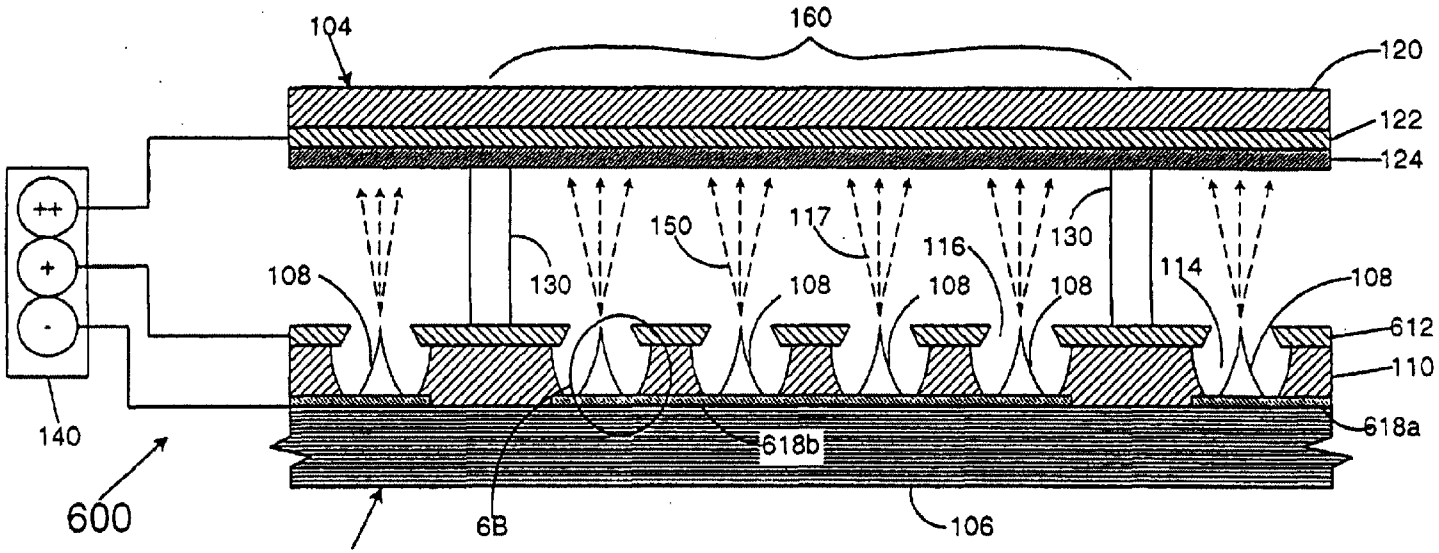
FIG. 6A shows a sectional view of a FED constructed according to the invention in which the column lines and the grid layer have been fabricated using multilayer conductors.
Figure 6B:
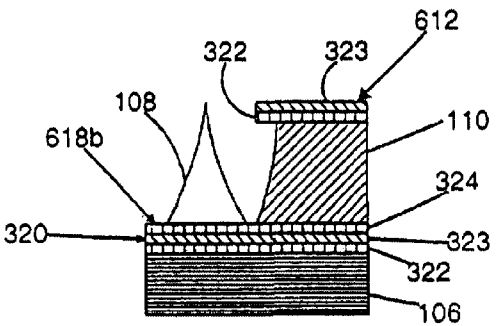
FIG. 6B shows a magnified view of a small portion of the FED shown in FIG. 6A.

FIGS. 6A and 6B illustrate another specific application for multilayer conductor 320. More specifically, FIG. 6A shows a sectional view of a FED 600 constructed according to the invention. FED 600 is similar to prior art FED 100 (as shown in FIGS. 1A and 1B). However, in FED 600 the column lines 618 and the grid layer 612 are fabricated using multilayer conductors constructed according to the invention. FIG. 6B shows a magnified view of the portion of FED 600 indicated by the oval 6B as shown in FIG. 6A. As shown in FIG. 6B, the column line 618*b* includes a primary conductive line 323 disposed between lower and upper protective lines 322, 324. The lower protective line 322 separates the primary conductive line 323 from substrate 106, which could be fabricated for example from glass. The upper protective line 324 separates the primary conductive line 323 from silicon-based layers (e.g., dielectric layer 110) disposed above the column line. It will be appreciated that other layers that are not shown in FIGS. 6A and 6B could be disposed between the column lines and the emitters 108 or the dielectric layer 110. Similarly, other layers that are not shown could be disposed between the column lines and the substrate 106.

As is also shown in FIG. 6B, the grid layer 612 includes a primary conductive line 323 disposed above a lower protective line 322. The lower protective line 322 separates the primary conductive line from the dielectric layer 110. In the case of the grid layer 612, the upper protective line may be eliminated since there is no silicon-based layer in contact with the upper portion of the grid layer. Rather, the grid layer is spaced apart form the faceplate 104 and a vacuum separates the grid layer and faceplate. Grid layer 612 is an example of a two-layer version of a multilayer conductor constructed according to the invention. It will be appreciated however that grid layer 612 could also include an upper protective line. Such an upper protective line could for example separate the primary conductive line from the spacers 130.

As discussed above, in multilayer conductors constructed according to the invention, the protective lines (or sheaths as illustrated in FIG. 3B) are preferably fabricated from chromium. In addition to chromium's advantageous characteristics of physical stability, chromium is also advantageous because it is conductive. If a break were to develop in the primary conductive line (e.g., due to a flaw in the fabrication process or due to some mechanical stress), the chromium protective lines could provide a conductive bridge around the break. Therefore, an electronic circuit constructed according to the invention using multilayer conductors can continue to operate even if breaks develop in some of the aluminum conductive lines in the circuit. Similar breaks in aluminum conductive lines in a prior art circuit would typically render the circuit inoperable. The multilayer conductor of the invention therefore provides increased reliability and an increased tolerance for fabrication flaws.

All conductors can be characterized by a per-unit-length electrical resistance. Referring to FIG. 2B, the per-unit-length electrical resistance of a prior art aluminum line.is a function of the cross-sectional area, or the product of the thickness T and the width W, of the line. In general, per-unit-length electrical resistance decreases as the cross-sectional area of the conductor increases. Referring now to FIG. 3A, the per-unit-length electrical resistance of multilayer conductor 320 is a function of the per-unit-length electrical resistances of the primary conductive line 323 and of the protective lines 322, 324. The primary conductive line 323 and the two protective lines 322, 324 behave electrically as three resistors connected together in parallel. As is well known, the electrical resistance provided by a network of parallel connected resistors is lower than the electrical resistance provided by any one of the resistors. Therefore, the per-unit-length electrical resistance provided by multilayer conductor 320 is lower than the per-unit-length electrical resistance provided by the primary conductive line 323 or the protective lines 322, 324. In general, the per-unit-length electrical resistance provided by multilayer conductor 320 will depend on the cross-sectional area of the primary and protective lines. In any given application, the per-unit-length electrical resistance can be tuned by adjusting the width W or the thickness T of the lines. In typical preferred embodiments, the width W of multilayer conductor 320 ranges from 1,000 Angstroms to 4,000 Angstroms, and the thickness T of each of the primary and protective lines ranges from 1000 to 2000 Angstroms. In one preferred embodiment of an FED constructed according to the invention, the column lines are fabricated using multilayer conductors 320, the width W of the column lines is equal to 2,000 Angstroms and the thicknesses of the primary conducive line and the upper and lower protective lines are all equal to 2,000 Angstroms.

Another advantage of fabricating the protective lines from chromium relates to corrosion resistance. Chromium is generally more resistant than aluminum to corrosion by etchants commonly used in integrated circuit fabrication processes. The chromium protective lines tend to protect the aluminum primary conductive lines from corrosion during the fabrication process. Use of the multilayer conductor of the invention can therefore increase the yield of integrated circuit fabrication processes.

Another advantage of multilayer conductor 320 is that it is relatively inexpensive to fabricate. Multilayer conductor 320 can be fabricated using a photo lithographic process that includes the same number of imaging steps used to fabricate prior art aluminum conductive lines. As is well known, the imaging steps tend to be the most expensive steps in any photo lithographic process. It is therefore advantageous that multilayer conductor 320 can be fabricated without the use of any additional imaging steps.

Briefly multilayer conductor 320 can be fabricated by successively forming or depositing (e.g., by DC or RF sputtering or by chemical vapor deposition) layers of chromium, aluminum, chromium, and photoresist. The photoresist is then imaged, or patterned, and cured. Four etching steps are then performed to successively remove (1) the uncured photoresist; (2) all portions of the upper chromium layer not disposed under cured photoresist; (3) all portions of the aluminum layer not disposed under cured photoresist; and (4) all portions of the lower chromium layer not disposed under cured photoresist. It will therefore be appreciated that when fabricating multilayer conductor 320 instead of prior art aluminum lines, two additional deposition steps are used (i.e., to deposit the two chromium layers) and two additional etching steps are used (i.e., to remove portions of the two chromium layers). However, since deposition and etching steps are relatively inexpensive, the additional cost of fabricating multilayer conductors 320 instead of prior art aluminum lines is relatively small. As discussed above, it is generally more expensive to fabricate multilayer conductor 320' than conductor 320. This is because additional imaging steps are generally required to fabricate chromium lines that are wider than the central aluminum line. However, the additional expense of fabricating conductor 320' may be justified in some applications.

The multilayer conductors discussed above have been described as having primary conductive lines fabricated from aluminum and protective lines (or sheaths) formed form chromium. There are two primary reasons for selecting aluminum for the primary conductive line and for selecting chromium for the protective lines. First, aluminum has been the conductor of choice for at least the last ten years for use in integrated circuits, and techniques for forming and patterning aluminum layers are well developed. Second, almost every layer used in modern integrated circuits is silicon-based. Therefore, given the current state of the integrated circuit arts, it is desirable to use aluminum as the primary conductor and to use chromium to protect the aluminum conductors from the deleterious effects that occur when aluminum is disposed in physical contact with silicon. However, it should be appreciated that other materials could be used for the primary conductive lines and the protective lines. For example, in some embodiments, aluminum alloys, copper or copper containing alloys, or other low resistance materials could be substituted for aluminum in the primary conductive lines. As another example, chromium alloys or tungsten could be used in place of chromium for the protective lines. In general, the materials used in the primary and protective lines should be selected (1) so that the primary and protective lines are physically stable when disposed in physical contact and (2) the protective lines are physically stable when disposed in physical contact with materials that will surround the multilayer conductor.

Figure 7:
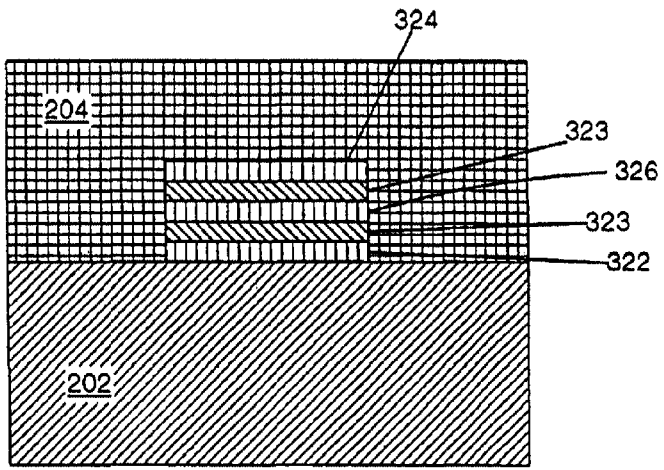
FIG. 7 shows a magnified sectional view of another multilayer conductor constructed according to the invention.

Multilayer conductors constructed according to the invention have been discussed in terms of having two layers (e.g., as in the case of the grid layer 612 shown in FIGS. 6A and 6B) or three layers (e.g., as shown in FIG. 3A). However, it will be appreciated that multilayer conductors constructed according to the invention could include other numbers of layers. FIG. 7 illustrates a five-layer version of a multilayer conductor constructed according to the invention. The illustrated multilayer conductor includes two primary conductive lines 323 and three protective lines 322, 324, 326. Protective line 326 is disposed between the two primary conductive lines 323, and protective lines 322 and 324 are disposed at the bottom and top, respectively, of the multilayer conductor. Multilayer conductors could of course be constructed according to the invention using other numbers of layers.

Since certain changes may be made in the above without departing from the scope of the invention herein involved, it is intended that all matter contained in the above description or shown in the accompanying drawing shall be interpreted in an illustrative and not a limiting sense.

What is claimed is:

1. A structure for use in a field emission display including;

a substrate;

a multiplicity of emitters disposed over the substrate;

a dielectric layer disposed over the substrate;

a conductive grid layer disposed over the dielectric layer;

a conductor disposed between the substrate and the dielectric layer, the conductor being electrically coupled to at least one of the emitters, the conductor including a first portion comprising aluminum and a second portion comprising chromium, such that at least some of the aluminum is adjacent at least some of the chromium.

2. A structure according to claim 1, the second portion of the conductor being disposed between the substrate and the first portion of the conductor.

3. A structure according to claim 1, the conductive grid layer including a first portion comprising aluminum and a second portion comprising chromium.

4. A structure for use in a field emission display including:

a substrate;

a multiplicity of emitters disposed over the substrate;

a dielectric layer disposed over the substrate;

a conductive grid layer disposed over the dielectric layer; and a conductor disposed between the substrate and the dielectric layer, the conductor being electrically coupled to at least one of the emitters, the conductor including a first portion comprising aluminum and a second portion comprising chromium, the second portion of the conductor being disposed between the substrate and the first portion of the conductor, the conductor further including a third portion comprising chromium, the third portion of the conductor being disposed between the dielectric layer and the first portion of the conductor.

5. A structure for use in a field emission display including:

a substrate;

a multiplicity of emitters disposed over the substrate;

a dielectric layer disposed over the substrate;

a conductive grid layer disposed over the dielectric layer;

a conductor disposed between the substrate and the dielectric layer, the conductor being electrically coupled to at least one of the emitters, the conductor including a first portion comprising aluminum and a second portion comprising chromium. the second portion of the conductor being disposed between the dielectric layer and the first portion of the conductor.

6. A structure according to claim 5, the conductor further including a third portion comprising chromium, the third portion of the conductor being disposed between the substrate and the first portion of the conductor.

7. A structure for use in a field emission display including:

a substrate;

a multiplicity of emitters disposed over the substrate;

a dielectric layer disposed over the substrate;

a conductive grid layer disposed over the dielectric layer, the conductive grid layer including a first portion comprising aluminum and a second portion comprising chromium, the second portion of the grid layer being disposed between the dielectric layer and the first portion of the grid layer;

a conductor disposed between the substrate and the dielectric layer, the conductor being electrically coupled to at least one of the emitters, the conductor including a first portion comprising aluminum and a second portion comprising chromium.

8. A structure for use in a field emission display including:

a substrate;

a multiplicity of emitters disposed over the substrate;

a dielectric layer disposed over the substrate;

a conductor disposed between the substrate and the dielectric layer;

a conductive grid layer disposed over the dielectric layer, the conductive grid layer including a first portion comprising aluminum and a second portion comprising chromium, the second portion of the grid layer being disposed between the dielectric layer and the first portion of the grid layer.

9. A structure according to claim 8, the conductor including a first portion comprising aluminum and a second portion comprising chromium.

10. A structure according to claim 9, the second portion of the conductor being disposed between the substrate and the first portion of the conductor.

11. A structure according to claim 10, the conductor further including a third portion comprising chromium, the third portion of the conductor being disposed between the dielectric layer and the first portion of the conductor.

12. A structure according to claim 9, the second portion of the conductor being disposed between the dielectric layer and the first portion of the conductor.

13. A structure according to claim 12, the conductor further including a third portion comprising chromium, the third portion of the conductor being disposed between the substrate and the first portion of the conductor.

14. A structure for use in a field emission display including:

a substrate;

a dielectric layer disposed over the substrate, the dielectric layer defining a multiplicity of apertures;

a multiplicity of emitters, each of the emitters corresponding to one of the apertures, each emitter being disposed over the substrate within its corresponding aperture;

a conductive grid layer disposed over the dielectric layer;

a conductor disposed between the substrate and the dielectric layer, the conductor being electrically coupled to at least one of the emitters, the conductor including a first line, a second line, and a third line, at least a portion of the first line being disposed between the second line and the substrate, at least a portion of the third line being disposed between the second line and the dielectric layer, the second line comprising aluminum, the first and third lines comprising chromium.

15. A structure according to claim 14, wherein the conductive grid layer includes a fourth line and a fifth line, the fourth line being disposed between the dielectric layer and the fifth line.

16. A structure according to claim 15, wherein the fourth line comprises chromium.

17. A structure according to claim 15, wherein the fifth line comprises aluminum.

18. A structure for use in a field emission display including:

a substrate;

a dielectric layer disposed over the substrate, the dielectric layer defining a multiplicity of apertures;

a multiplicity of emitters, each of the emitters corresponding to one of the apertures, each emitter being disposed over the substrate within its corresponding aperture;

a conductive grid layer disposed over the dielectric layer, the conductive grid layer including a first line and a second line, the first line being disposed between the second line and the dielectric layer, the second line comprising aluminum, the first line comprising chromium.

19. A structure according to claim 18, further comprising a conductor, at least a portion of the conductor being disposed between the dielectric layer and the substrate.

20. A structure according to claim 19, wherein the conductor includes a third line, a fourth line, and a fifth line, the third line being disposed between the substrate and the fourth line, the fifth line being disposed between the dielectric layer and the fourth line.

21. A structure according to claim 20, wherein fourth line comprises aluminum.

22. A structure according to claim 20, wherein the third and fifth lines comprise chromium.

23. A field emission display including:

a faceplate;

a baseplate including;

a substrate;

a multiplicity of emitters disposed over the substrate;

a dielectric layer disposed over the substrate;

a lower conductor electrically coupled to at least one of the emitters, the lower conductor including a first portion comprising aluminum and a second portion comprising chromium, such that at least some of the aluminum is adjacent at least some of the chromium;

an upper conductor disposed over the dielectric layer, the upper conductor including a first portion comprising aluminum and a second portion comprising chromium, the at least one emitter emitting electrons that travel towards the faceplate in response to voltages applied to the lower conductor, the upper conductor, and the faceplate.

24. A structure for use in a field emission display including:

a substrate;

a multiplicity of emitters disposed over the substrate;

a dielectric layer disposed over the substrate;

a conductive grid layer disposed over the dielectric layer;

a conductor disposed between the substrate and the dielectric layer, the conductor being electrically coupled to at least one of the emitters, the conductor including a first conductive material and a second conductive material, the first conductive material comprising chromium and the second conductive material comprising aluminum, such that at least some of the aluminum is adjacent at least some of the chromium.

25. A structure according to claim 24, a layer of the first conductive material being disposed between the substrate and the second conductive material.

26. A structure according to claim 24, the second conductive material comprising aluminum.

27. A structure according to claim 24, the second conductive material comprising copper.

28. A structure for use in a field emission display including:

a substrate;

a multiplicity of emitters disposed over the substrate;

a dielectric layer disposed over the substrate;

a conductive grid layer disposed over the dielectric layer;

a conductor disposed between the substrate and the dielectric layer, the conductor being electrically coupled to at least one of the emitters, the conductor including a first conductive material and a second conductive material, the first conductive material comprising chromium, a layer of the first conductive material being disposed between the dielectric layer and the second conductive material.

29. A structure for use in a field emission display including:

a substrate;

a multiplicity of emitters disposed over the substrate;

a dielectric layer disposed over the substrate;

a conductor disposed between the substrate and the dielectric layer;

a conductive grid layer disposed over the dielectric layer, the conductive grid layer including a first conductive material and a second conductive material, wherein the first conductive material comprises chromium, a layer of the first conductive material being disposed between the second conductive material and the dielectric layer.

30. A structure according to claim 29, wherein the second conductive material comprises aluminum.

31. A structure according to claim 29, wherein the second conductive material comprises copper.

* * * * *